United States Patent [19]

Zenger

[11] Patent Number: 5,033,254

[45] Date of Patent: Jul. 23, 1991

[54] HEAD-SPACE CALIBRATED LIQUIFIED GAS DISPENSING SYSTEM

[75] Inventor: Richard D. Zenger, Downers Grove, Ill.

[73] Assignee: American National Can Company, Chicago, Ill.

[21] Appl. No.: 513,096

[22] Filed: Apr. 19, 1990

[51] Int. Cl.[5] ..... B65B 55/18; B65B 31/04

[52] U.S. Cl. ..... 53/431; 53/432; 53/53; 53/493; 53/510

[58] Field of Search ..... 53/431, 432, 53, 493, 53/503, 510, 237; 141/82

[56] References Cited

U.S. PATENT DOCUMENTS

| | | | |
|---|---|---|---|
| 3,802,252 | 4/1974 | Hayward et al. | 73/52 |
| 4,407,340 | 10/1983 | Jensen | 141/82 X |
| 4,489,767 | 12/1984 | Yamada | 141/82 X |
| 4,583,346 | 4/1986 | Kameda | 53/431 |
| 4,588,000 | 5/1986 | Malin | 53/432 X |
| 4,662,154 | 5/1987 | Hayward | 53/431 X |
| 4,691,496 | 9/1987 | Anderson et al. | 53/53 |
| 4,862,696 | 9/1989 | Runkvist et al. | 62/50.6 |
| 4,880,041 | 11/1989 | Yamada | 53/431 X |

FOREIGN PATENT DOCUMENTS

| | | | |
|---|---|---|---|
| 2089191 | 6/1982 | United Kingdom | 53/431 |

*Primary Examiner*—John Sipos

*Attorney, Agent, or Firm*—Robert A. Stenzel; Micheal D. Lake

[57] ABSTRACT

A system for introducing liquified gas into filled containers in a continuous container fill line (10), wherein, the dosage of liquified gas dispensed into each container is calibrated to the individual container's particular head-space volume. The system (10) includes measuring the head-space volume of each filled container in-line and communicating that measurement to a controller (28) which can adjust the dosage of liquified gas to be dispensed to each individual container. The system also provides for measuring the internal pressure of each container after sealing, which measurement is also communicated to the controller so that the controller can make additional dosage corrections and can direct the ejectment of improperly pressurized containers.

7 Claims, 1 Drawing Sheet

HEAD-SPACE CALIBRATED LIQUIFIED GAS DISPENSING SYSTEM

DESCRIPTION

1. Technical Field

The present invention relates generally to the addition of liquified gas to filled containers to produce selected container pressures after sealing and particularly relates to a method and apparatus to calibrate liquified gas dosages to individually measured container head-space volumes.

2. Background of the Invention

In the manufacture of metal cans, the gauge of metal used is dependant upon the product which is to be filled in the can. For instance, soft drinks are filled in aluminum cans that have thin side walls while hot filled juices are packaged in cans that have thick side walls that may be beaded. In recent years, the addition of small amounts of a liquified gas, usually nitrogen, to filled containers before sealing them has been widely practiced to pressurize the sealed cans. For example, U.S. Pat. Nos. 4,407,340 (Jenson, et al.) and 4,489,767 (Yamada) discloses such process.

The pressurization of cans provides for added crush and stacking strength for thin walled cans and avoids paneling in hot filled containers where product cooling causes vacuum pressures within a can. Thus, in a properly pressurized can, the can walls and end panels can be appropriately down gauged in relation to the added strength.

The amount of liquified gas added to a container and the head-space volume above the product filled into the container are critical elements in determining the resulting internal pressure of a container upon expansion of the liquified gas. Also, the temperature of hot filled products effects the internal pressure after cooling, according to Boyles law.

Conventionally, the dosage of liquified gas dispensed into a container is based on an average expected fill level of the containers in a continuous fill operation. Using this method, any variation in head-space volume due to variations in fill level would cause under and over pressurized containers. More recently, U.S. Pat. No. 4,662,154 was issued to Hayward. Hayward teaches the art of providing a closed loop control circuit between a liquid nitrogen dispenser and a pressure detector. The average internal pressure of recently sealed containers is monitored to adjust the dosage of liquid nitrogen added to containers being presently dosed. Containers not meeting the preset pressure range may be rejected.

Problems of uniform pressurization still remain using this method due to basing the dosage on the average pressure of already sealed containers. Whether a given container has a head-space volume that varies high or low, it will receive a dosage based upon an average head-space volume of containers previously sealed. Therefore, the range of container pressures can still vary widely.

Additional problems are caused by the fact that container pressure is the only monitored dosage criteria. Container pressure is measured after a container has already received a dosage and is sealed. This after-the-fact detection can result in high spoilage rates when there are sudden variations in product fill level. These sudden variations will not be detected until after the containers are sealed. Even more spoilage may result as the detection and correction of improper dosages is slow due to the averaging process. Containers must continue to be incorrectly dosed until the average values detect fluctuation.

SUMMARY OF THE INVENTION

The head-space volume calibrated liquified gas dispensing system (HSCLGDS) of the present invention provides for on-line dosage calibration of a liquified gas dispenser in a conventional container filling line. The liquified gas dispenser is automatically adjusted to deliver a dosage to each container which corresponds to the container's individually measured head-space volume.

The HSCLGDS generally includes an empty container in-feed station, a continuous container conveying system, a container product fill station, a container head-space sensing station, a liquified gas dispensing station, a container seaming station, a container internal pressure sensing station, a discharge conveyor and a reject apparatus.

The system provides for the on-line measurement of the head-space volume of each container after it has been filled with product and before the addition of liquified gas. The head-space volume measurement is communicated to a main controller which sends an appropriate control signal to the liquified gas dispenser so that the dosage of liquified gas delivered to each container corresponds directly to its individually measured head-space.

With dosages being exactly correlated to the individually measured requirements of each container, very uniform pressure ranges are obtained as opposed to dosages based on expected fill levels or after-the-fact average measurements. Therefore, containers can be down gauged as they will not be required to accommodate a wide pressure range. Furthermore, the system achieves lower spoilage rates due to improperly pressurized containers because the system detects fill variations before containers have received a dosage of liquified gas and the dosages can be adjusted correspondingly.

The HSCLGDS of the present invention further provides for measurement of the internal pressure of each container after seaming. Any improperly pressurized container is automatically rejected if over or under pressurized.

In a preferred embodiment of the invention, the container internal pressure measurement is communicated to the main controller which utilizes the pressure measurements to make internal signal adjustments so that current dosage adjustments for head-space volume are additionally corrected for recent dispensing performance.

This method of making separate adjustments for individually monitored head-space volume and dispensing performance achieves even more process control resulting in an even narrower range of pressure variation and lower spoilage rate.

Other advantages and aspects of the invention will become apparent upon making reference to the specification, claims, and drawings to follow.

DETAILED DESCRIPTION OF THE INVENTION

Figure 2:
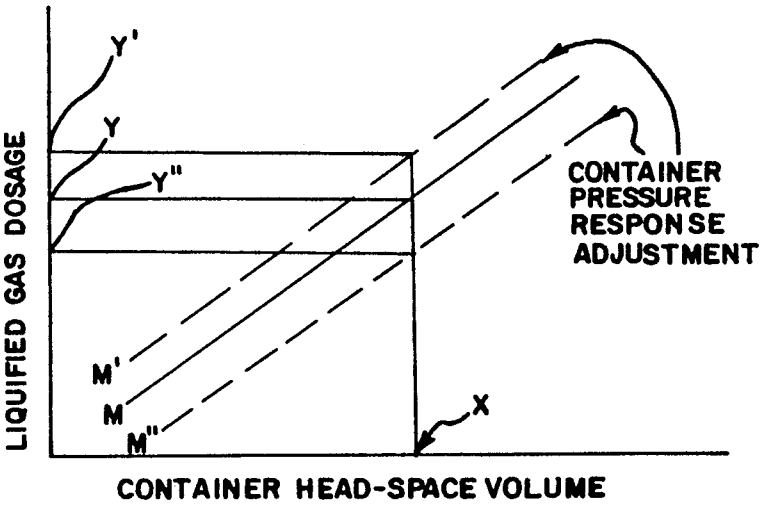
FIG. 2 is a chart depicting the relationship of internal container pressure feed-back adjustments to head-space volume adjustments in a preferred embodiment of the present invention.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to embodiment illustrated.

Figure 1:
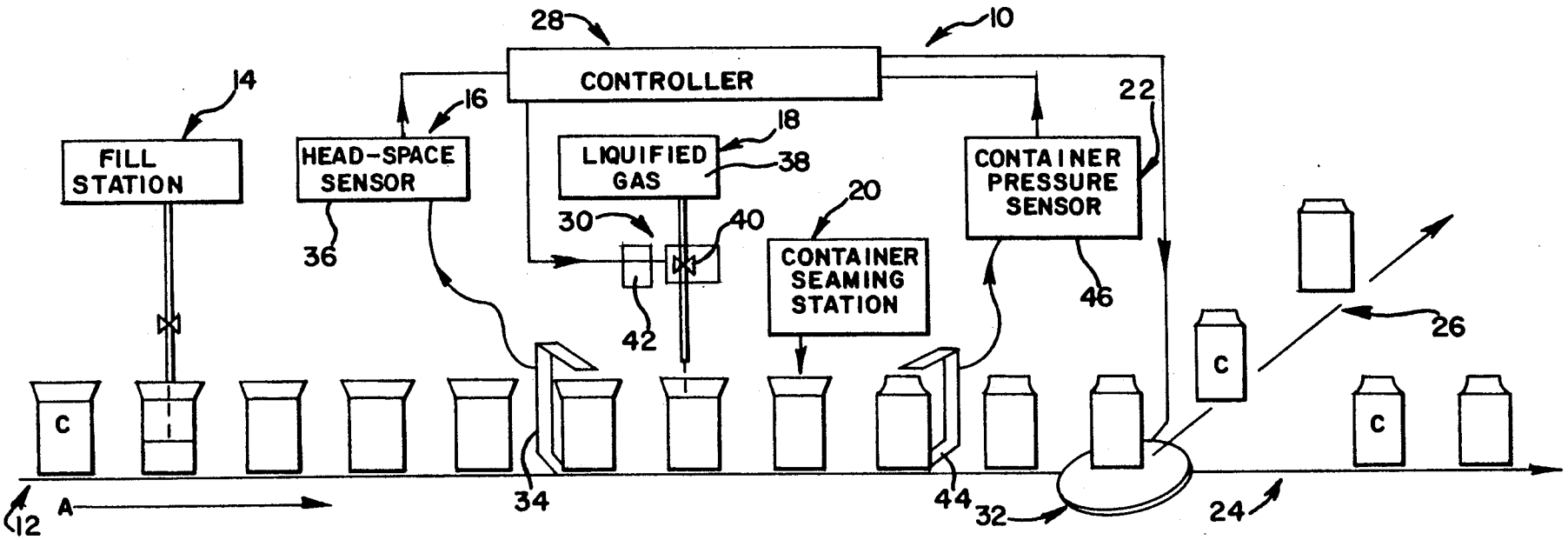
FIG. 1 is a schematic view of the head-space calibrated liquified gas dispensing system of the present invention.

Referring now to the drawings, FIG. 1 shows a schematic view of a preferred embodiment of the head-space calibrated liquified gas dispenser system of the present invention, generally referenced by 10.

FIG. 1 discloses the system as schematically configured in a conventional continuous metal container filler line utilizing liquified gas, commonly liquid nitrogen, to pressurize containers. In the broad aspects of the invention, a continuous line of equally spaced metal containers C progress in sequence along an empty container in-feed conveyor 12 moving in the direction indicated by arrow A, to a container fill station 14, a container head-space volume sensor 16, a liquified gas dispensing station 18, a container seaming station 20, a container internal pressure sensor 22, and then to either a discharge conveyor 24 or a reject conveyor 26.

Container fill station 14 is a conventional container filling apparatus and can be in the form of a beverage fill apparatus or a hot filling apparatus such as for juices. After a container C has been filled, the container moves along conveyor 12 to the container head-space sensing station 16. Station 16 is located a suitable distance from the liquified gas dispensing station as will be further detailed below.

The head-space volume of a filled container C is then measured as a function of fill height to total container height. The head-space volume measurement is then communicated to a controller unit 28. The container C is then sequenced into position at station 18 to receive a dosage of liquified gas. Controller unit 28 then sends an appropriate control signal to a liquified gas dispenser output apparatus 30 to affect the delivery of liquified gas to the container in a dosage which is relative to the individually measured head-space volume of the container.

After addition of the liquified gas to a container C, as is conventional, the container is quickly sequenced into seaming station 20 where the container is closed in a conventional seaming operation. The closed container C is then sequenced into container pressure sensing station 22 which is suitably located in relation to seaming station 20 as will be disclosed below. Each container is measured to determine its internal pressure by a conventional sensing apparatus such as a container surface deflection sensor. The container internal pressure measurement is then communicated to controller 28. If a container has been measured to be over or under pressurized, controller 28 sends an appropriate signal to a conventional discharge conveyor reject apparatus 32 to route an improperly pressurized container to a reject track 26. If the container is properly pressurized it is conveyed down discharge track 24. It will be appreciated that this process will also detect seamer malfunctions and reject containers with faulty ends.

In a preferred embodiment, the controller 28 utilizes the container internal pressure measurement of recently sealed containers to make further adjustments cooperative with the head-space volume adjustment communicated to liquified gas dispenser output apparatus 30.

FIG. 2 illustrates the feed back relationship of the container internal pressure measurement to head-space volume measurement adjustments. Lines M, M' and M'' of FIG. 2 do not attempt to depict the mathematical function which describes the relationship between head-space volume and dosage. FIG. 2 merely illustrates the relative relationship of container pressure measurements used as feed-back input to make further refined adjustment to a dosage as determined by head-space volume.

As an example, for any given head-space volume measurement X there is a corresponding appropriate liquified gas dosage Y as determined from line M. The position of line M is initially a function of the characteristics of the gas used, the product filled into a container and the desired resulting internal container pressure.

If, for example, controller 28 has received a container under-pressure measurement, controller 28 can adjust line M to a line M'. After correction, in this example, any given head-space volume X will then result in higher dosage, Y'. Line M'' illustrates a feed-back correction from over pressurized containers which results in a dosage Y'' for the same head-space volume measurement X. Thus, next sealed containers will receive a dosage that not only reflects their individually measured head-space volume but also is corrected for recent dispensing performance.

Referring again to FIG. 1, container fill station 14 is a conventional multivalve container filling apparatus for filling either beverage or hot fill materials.

Head-space volume sensing station 16 is preferably a Gamma 101 TM, Quantitative ValvChek TM, fill level monitor marketed by Peco Controls Corporation. The monitor is schematically represented as having a container sensing head 34 and an intermediate control unit 36 for intermediate control of and communication with the sensing head 34.

Sensing head 34 utilizes gamma radiation absorption characteristics to measure the fill level of a container. The sensing head is suitably mounted over the top of conveyor 12. The configuration of the sensing head provides a sampling window which each container passes through for in-line sampling.

Intermediate control unit 36 is microprocessor controlled and is equipped to communicate with controller 28 via standard RS-232 communication cable. The unit receives sampling data from sensing head 34 and employs statistical routines utilizing a large number of measurements to calculate the fill volume of a container to an accuracy of $\pm 0.01$ ounce. The monitor can measure the fill volume of up to 2,400 containers per minute.

The monitor is conventionally used to monitor fill level of containers so as to maintain quality control over container fill level. The manner in which the monitor functions may be better understood by reference to U.S. Pat. No. 4,691,496, granted Sept. 8, 1987 to Anderson et al. and by reference to the product brochures and technical manuals published by Peco Controls Corporation.

Sensing head 34 can be located at a point upstream from the liquified gas dispenser so as to measure the container head-space volume of the next container to receive a dosage of liquified gas as schematically illustrated in FIG. 1. In other embodiments, the sensing head 34 may also be located at any suitable position upstream of the liquified gas dispenser. Delivery of the appropriate dosage to the correct container may be achieved by a timing relationship. In that instance, for example, controller 28 stores the head-space volume measurements and delivers the appropriate dosage at a time determined by the distance from the sensing head 34 to the liquified gas dispenser output 30 and the speed of the conveyor 12.

Liquified gas dispensing station 18 is preferably a Linpulse TM dispenser, marketed by AGA Gas, Inc. (U.S. Pat. No. 4,862,696) The Linpulse TM dispenser is schematically represented in FIG. 1 as having a liquified gas storage and monitoring apparatus 38 and a liquified gas output apparatus, generally referenced by 30. Output apparatus 30 preferably includes a positive displacement dosage pump 40 and a servo or stepper motor 42. The stroke of pump 40 is controlled by a stop (not shown) that defines the volume of liquified gas dispensed. In a preferred embodiment, the stroke displacement is varied by servo motor 42, such as the brushless Servo 6000 marketed by EG & G Servo, which is cooperatively linked to the stop. Servo motor 42 positions the stop in sequence according to a signal from controller 28.

It should be appreciated that other types of liquified gas dispensers can be used in accordance with the present invention. For example, the controller 28 can provide a signal to vary the amount of time a dosage valve remains open depending on the measured head-space volume of a filled container. Examples of such dispensers are disclosed in U.S. Pat. Nos. 4,407,340 and 4,583,346.

The liquified gas dispenser output 30 is positioned over conveyor 12 and liquified gas dosages are dropped into filled containers as they are sequenced beneath.

Container seaming station 20 is a conventional container closing apparatus such as a double seaming apparatus for beverage packaging.

FIG. 1 discloses in schematic that container internal pressure sensing station 22 includes a container internal pressure sensing head 44 and an intermediate control unit 46 equipped for intermediate control of and communication with sensing head 44. Sensing station 22 is located at a point far enough downstream from the seaming station 20 so that the internal pressure of the closed containers has stabilized at a constant value.

Sensing station 22 is preferably an ADR-50 TM proximity sensor, marketed by Food Instrument Co. The proximity sensor is designed to sense container end deflection in relationship to the double seam of the container by use of a differential transformer. This end deflection is caused by the expansion of the liquified gas upon temperature equalization within the container. The ADR-50 TM proximity sensor is capable of detecting 0.005 inch variation in end deflection from the seam edge to the end check point as a can passes under the sensing head 44. A similar proximity sensor is disclosed in U.S. Pat. No. 3,802,252.

In other embodiments, the intermediate controller 46 can send a signal directly to reject apparatus 32 to divert under or over pressurized containers rather than having the reject signal being sent from controller 28. The manner in which the ADR-50 functions may be better understood by reference to the technical literature published by the manufacturer.

The HSCLGDS can be adjusted to process thin walled metal containers, glass containers and plastic containers. In the processing of containers other than metal closures, a preferred means for measuring internal container pressure is an optical sensing device such as marketed by Dolan-Jenner. With the optical device, container closer deflection is measured by containers passing in-line through a reference beam of light. Deflection is sensed by a fiber optic receiver.

Controller 28 is a computerized control device which is preferably integral with an overall filling line monitor and control system such as an Apache TM control system, marketed by the Assignee of the present invention.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A method for introducing liquified gas into filled containers in a continuous container filler line, comprising:

measuring the head-space volume of each container after filling;

communicating the head-space measurement of each container to a responsive means for controlling the output of a liquified gas dispenser;

adjusting the output of a liquified gas dispenser relative to the measured head-space volume so that each container receives a dosage of liquified gas relative to its measured head-space volume and so that each individual filled container will produce a selected desirable internal pressure after the container is sealed;

dispensing the liquified gas into the container after dispenser output is adjusted; and sealing the container.

2. The method of claim 1, including the further steps of measuring the internal pressure of the sealed container;

communicating the internal pressure measurement to a means to reject containers from a continuous container discharge line so that any container which is over or under pressurized will be selectively ejected from the discharge line.

3. A method as defined in claim 2, which includes communicating the measurement of the internal pressure of the sealed containers to the response means for controlling the output of a liquified gas dispenser; and, adjusting said responsive means so that the dosage to the next containers can be corrected in response to any measured over or under pressure in recently sealed containers simultaneously with the adjustment for each container's individually measured head-space volume.

4. An apparatus for adjusting the dosage of liquified gas introduced into a filled container wherein the dosage for each container is calibrated to the particular head-space volume of that container, in a continuous container filler line having an empty container in-feed conveyor, a container fill station, a container sealing station and a discharge conveyor, said apparatus comprising:

dispensing means for dispensing a liquified gas to a filled container;

control means for controlling an output of said dispensing means;

head-space sensing means for sensing the volume of head-space of a filled container;

said control means being responsive to said head-space sensing means so that each container receives a dosage of liquified gas which is calibrated to the particular head-space volume of the container to achieve a proper pressurization of each container when sealed.

5. An apparatus as defined in claim 4, further including pressure sensing means for sensing internal pressure of a container after sealing with said control means being co-responsive to said head-space sensing means and to said pressure sensing means.

6. An apparatus as defined in claim 4, further including:

pressure sensing means for sensing an internal pressure of a container once sealed;

reject means for rejecting improperly-pressurized containers; and, reject control means for controlling said reject means so that if a container is improperly pressurized, the container can be directed to said reject means, said reject control means being responsive to said pressure sensing means.

7. An apparatus as defined in claim 5, further including:

reject means for rejecting improperly pressurized containers; and reject control means for controlling said reject means so that if a container is improperly pressurized, the container can be directed to said reject means.

* * * * *